US008860322B2

(12) United States Patent
Wei et al.

(10) Patent No.: US 8,860,322 B2
(45) Date of Patent: Oct. 14, 2014

(54) PIEZOELECTRIC RESONATOR LIGHT-EMITTING-DIODE (LED) DRIVING CIRCUIT

(71) Applicants: Midas Wei Trading Co., Ltd., Taipei (TW); Champion Elite Company Limited, Road Town (VG)

(72) Inventors: Tao-Chin Wei, Taipei (TW); Yuan-Ping Liu, Taipei (TW)

(73) Assignees: Midas Wei Trading Co., Ltd., Taipei (TW); Champion Elite Company Limited, Road Town, Tortola (VG)

( * ) Notice: Subject to any disclaimer, the term of this patent is extended or adjusted under 35 U.S.C. 154(b) by 21 days.

(21) Appl. No.: 13/707,412

(22) Filed: Dec. 6, 2012

(65) Prior Publication Data

US 2013/0141000 A1 Jun. 6, 2013

(30) Foreign Application Priority Data

Dec. 6, 2011 (TW) ..... 100144870 A

(51) Int. Cl.
*H05B 37/00* (2006.01)
*H05B 33/08* (2006.01)
*H05B 37/02* (2006.01)

(52) U.S. Cl.
CPC ..... *H05B 37/02* (2013.01); *H05B 33/0815* (2013.01)
USPC ..... 315/200 R

(58) Field of Classification Search
CPC ..... G03G 15/5004; G03G 15/0831; H03B 5/362; H02M 2001/007
USPC ..... 315/178–183, 200 R, 205, 209 R
See application file for complete search history.

(56) References Cited

U.S. PATENT DOCUMENTS

| | | | | |
|---|---|---|---|---|
| 4,588,917 | A * | 5/1986 | Ratcliff | 310/316.01 |
| 5,034,662 | A * | 7/1991 | Nishida et al. | 315/241 P |
| 5,739,622 | A * | 4/1998 | Zaitsu | 310/316.01 |
| 6,147,433 | A * | 11/2000 | Reineke et al. | 310/316.03 |
| 6,735,802 | B1 * | 5/2004 | Lundell et al. | 15/22.1 |
| 7,019,436 | B2 * | 3/2006 | Rueger et al. | 310/316.03 |
| 8,513,855 | B2 * | 8/2013 | Wu et al. | 310/316.03 |
| 2005/0030774 | A1 * | 2/2005 | Vazquez Carazo | 363/84 |

* cited by examiner

*Primary Examiner* — Thienvu Tran
(74) *Attorney, Agent, or Firm* — Muncy, Geissler, Olds & Lowe, P.C.

(57) ABSTRACT

A piezoelectric resonant LED driving circuit, wherein a rectifier is used to rectify an AC voltage provided by the supply main into a DC voltage. Then, a quasi-resonant switching module performs resonance by means of the DC voltage to produce an induced current, to raise resonance frequency to operation frequency of a piezoelectric oscillator. Finally, the piezoelectric oscillator performs resonance and filtering using the induced current, to generate a sine wave current. Then, the sine wave current is rectified to output a DC current to drive an LED module.

7 Claims, 9 Drawing Sheets

PIEZOELECTRIC RESONATOR LIGHT-EMITTING-DIODE (LED) DRIVING CIRCUIT

BACKGROUND OF THE INVENTION

1. Field of the Invention

The present invention relates to a piezoelectric resonant light-emitting-diode (LED) driving circuit, and in particular to a thin piezoelectric oscillator coupled with a single active switch to drive an LED.

2. The Prior Arts

With the rising price of oil, the ample supply of energy resources is a most important issue. Therefore, how to conserve energy and electricity is a critical task of the Industries. In this respect, lighting device occupying a very large proportion of energy consumption, has become an important item of energy conservation. Presently, the LED has been used widely as illumination device due to its advantages of high color saturation, mercury free, long service life, fast turn-on and turn-off speed, high illumination, low power consumption, light weight, thin profile, and compact size.

Presently, piezoelectric transformer is used mainly to drive an LED circuit. Wherein, voltage of AC power supply is rectified into DC voltage, then it goes through a full-bridge or half-bridge power amplifier to provide voltage of square wave. Then, a top-and-bottom symmetric pseudo-sine wave current is obtained for the square wave voltage through the resonance of an external inductor and input capacitance of a piezoelectric transformer, for inputting it into the piezoelectric transformer for voltage conversion. Finally, the AC current output by the piezoelectric transformer is rectified into a DC current by a rectifier to drive an LED. However, the design and disposition of a full-bridge circuit having four switches and a half-bridge circuit having double switches could increase cost and space occupied by the circuit. Also, the circuit design is rather complicated. Therefore, how to simplify the circuit design while achieving the same LED driving capability is a problem that has to be solved urgently.

Therefore, presently, the design and performance of the piezoelectric transformer LED driving circuit is not quite satisfactory, and it has much room for improvements.

SUMMARY OF THE INVENTION

In view of the problems and shortcomings of the prior art, the present invention provides a piezoelectric resonant LED driving circuit. Wherein, a thin piezoelectric oscillator is coupled with a single active switch to drive an LED, to overcome the shortcoming and drawback of the prior art.

A major objective of the present invention is to provide a piezoelectric resonant LED driving circuit. Wherein, a single switch replaces double switches of a half-bridge circuit, to achieve zero-voltage-switching (ZVS) and lower the switching power loss effectively during resonance, while reducing the cost of circuit.

In order to achieve the objective mentioned above, the present invention provides a piezoelectric resonant LED driving circuit, comprising a rectifier, a quasi-resonant switching module, a piezoelectric oscillator, and an LED module. The rectifier receives an AC voltage, such as from a supply main, and rectifies the AC voltage into a DC voltage. The quasi-resonant switching module is connected to the rectifier, and it includes an inductor, a capacitor and a switch. Wherein, the switch and the capacitor are connected in parallel, and then they are connected between the inductor and the piezoelectric oscillator, to perform resonance using the DC voltage to produce an induced current. The piezoelectric oscillator is connected to the quasi-resonant switching module to receive the induced current, and after resonating and filtering, generate a sine wave current. Moreover, the LED module is connected to the piezoelectric oscillator to receive the sine wave current, and rectify it into a DC current to drive the LED module.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
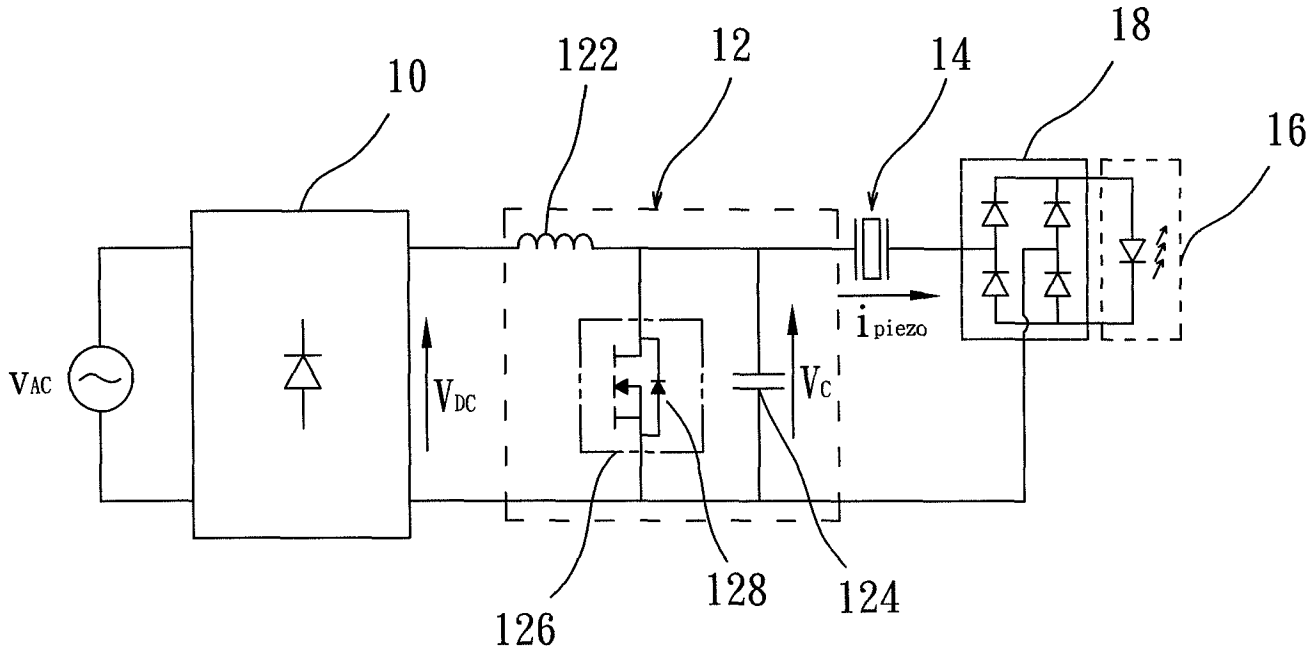
FIG. 1 is a circuit diagram of a piezoelectric resonant LED driving circuit according to a first embodiment of the present invention.

Refer to FIG. 1 for a circuit diagram of a piezoelectric resonant LED driving circuit according to a first embodiment of the present invention. As shown in FIG. 1, the piezoelectric resonant LED driving circuit includes a rectifier 10, a quasi-resonant switching module 12, a piezoelectric oscillator 14, and an LED module 16, and a rectifier circuit 18. The quasi-resonant switching module 12 is connected between the rectifier 10 and the piezoelectric oscillator 14, and the rectifier circuit 18 is connected between the piezoelectric oscillator 14 and the LED module 16. Wherein, the quasi-resonant switching module 12 includes an inductor 122, a capacitor 124, and a switch 126. The drain of the switch 126 is connected in parallel with the capacitor 124, and then they are connected between the inductor 122 and the piezoelectric oscillator 14. The inductor 122 is connected between the rectifier 10 and the switch 126, while the piezoelectric oscillator 14 is connected between the inductor 124 and the rectifier circuit 18.

Figure 2:
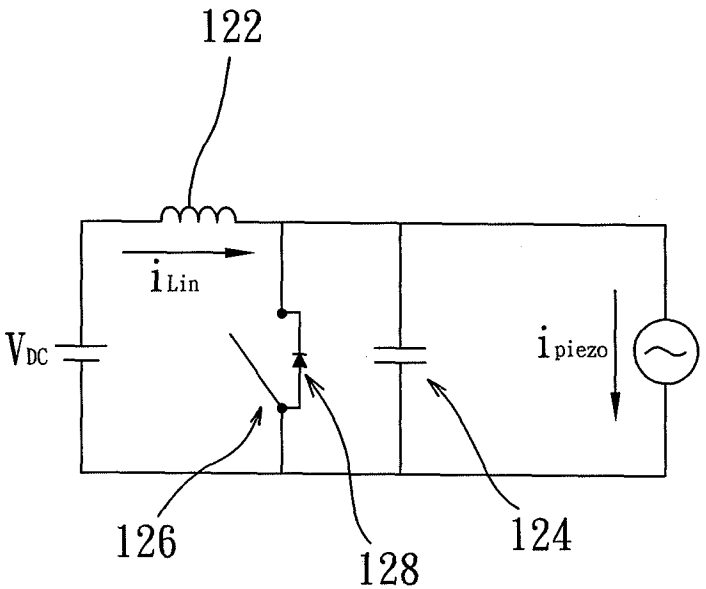
FIG. 2 is an equivalent circuit diagram of a quasi-resonant switching module when the switch is switched off according to the present invention.
Figure 3:
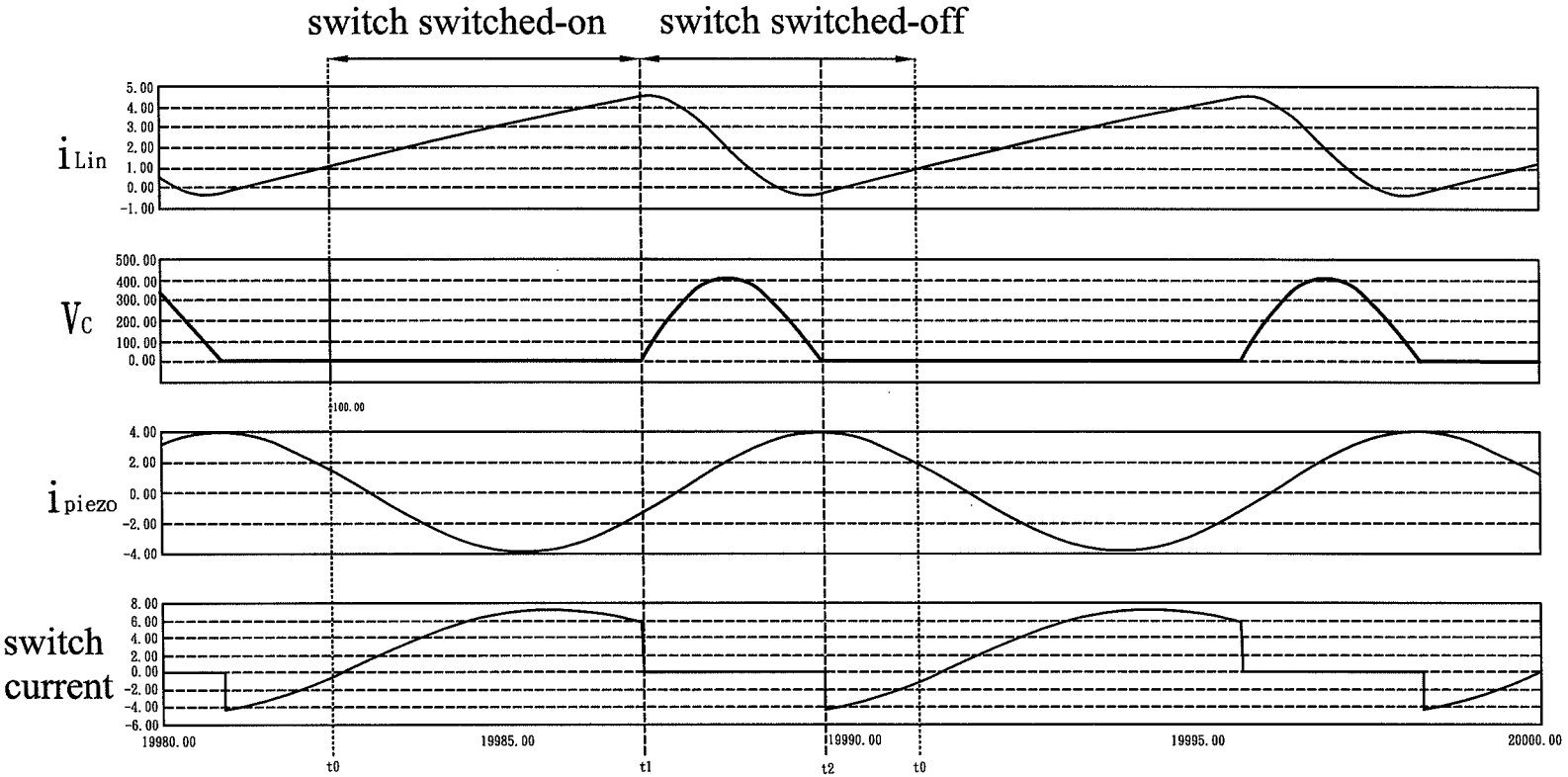
FIG. 3 is a waveform diagram of a quasi-resonant switching module in operation according to the present invention.

The rectifier 10 receives an input AC voltage $V_{AC}$ from a supply main, and rectifies it into a DC voltage $V_{DC}$ of positive half cycle. Wherein, the rectifier 10 is a bridge rectifier having for example, a Schottky Barrier Diode (SBD), a fast recovery diode (FRD), or a Zener diode (ZD). Refer to FIGS. 2 and 3 at the same time for an equivalent circuit diagram of a quasi-resonant switching module 12 when its switch is switched off according to the present invention; and a waveform diagram of the quasi-resonant switching module 12 in operation according to the present invention. Wherein, the quasi-resonant switching module 12 receives a DC voltage. When the switch 126 is switched on, as shown in time interval t0-t1 of the waveform diagram, at this time, the DC voltage starts to charge the inductor 122, to increase the current in the inductor 122, so that the voltage across the inductor 122 is $V_{DC}$. When the switch 126 is switched off, as shown in time interval t1-t2 of the waveform diagram, at this time, the inductor 122 and the capacitor 126 start to resonate, to produce an induced current ($i_{Lin}$) and a capacitance voltage $V_C$. To be more specific, during resonance, the inductor 122 starts to discharge to the capacitor 124, to charge the capacitor 124, so that its capacitance voltage increases from low level to high level. At this time, the capacitance voltage is at its maximum value (for example, twice the value of $V_{DC}$). Through the resonating and filtering characteristic of the piezoelectric oscillator 14, the induced current passing through piezoelectric oscillator 14 is filtered into a sine wave current (namely, a piezoelectric current). Then, it is transmitted to the rectifier circuit 18, and the sine wave current is rectified into a DC current, to drive the LED module 16 to emit light. When the capacitance voltage returns from high voltage level to low voltage level ($V_C$=0), a parasitic diode 128 of the switch 126 is turned on, to force the resonance to end. By way of example, when the switch 126 remains switched off, and after the end of resonance, the waveform is as shown in time interval t2-t0. At this time, the diode current on the parasitic diode 128 and the piezoelectric current ($i_{piezo}$) on the piezoelectric oscillator 14 are equal. Since the voltage across the capacitor 124 is zero, that makes the voltage across the inductor to be $V_{DC}$, to start charging the inductor 122. At the end of time interval t2-t0, the switch 126 is again switched to a switch-on state, to repeat executing the operations of time interval t0-t1. At this time, the voltage across the capacitor 124 is zero, thus achieving zero voltage switching (ZVS) and reducing power loss of the switch 126. It is worth to note that, the quasi-resonant switching module 12 must be used to raise the frequency of the DC voltage $V_{DC}$ to be close to or greater than the operation frequency of the piezoelectric oscillator 14, to ensure achieving Zero-Voltage-Switching (ZVS), as shown in the following equation of operation frequency:

$$\frac{1}{2\pi\sqrt{L_{in}C}} \rangle f_{sw} \rangle f_{piezo}$$

Wherein, $L_{in}$ is the inductance value of the inductor 122, C is the capacitance value of capacitor 124, $f_{SW}$ is the switching frequency of the switch 126, and $f_{piezo}$ is the resonating-and-filtering frequency of the piezoelectric oscillator 14.

The resonance frequency of the inductor 122 and capacitor 124 is greater than the switching frequency of the switch 126, and the resonating-and-filtering frequency (namely, the operation frequency) of the piezoelectric oscillator 14, while the switching frequency of the switch 126 is greater than the resonating-and-filtering frequency of the piezoelectric oscillator 14.

Figure 4:
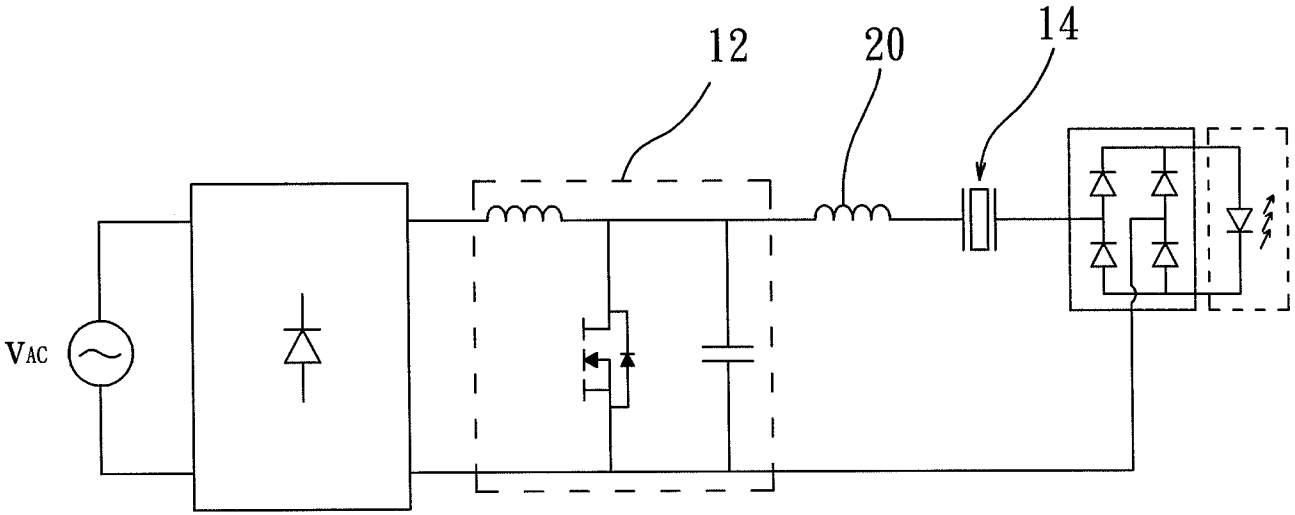
FIG. 4 is a circuit diagram of a piezoelectric resonant LED driving circuit according to a second embodiment of the present invention.

Then, refer to FIG. 4 for a circuit diagram of a piezoelectric resonant LED driving circuit according to a second embodiment of the present invention. The difference between the second embodiment and the first embodiment is that, in the second embodiment, a filter inductor 20 is connected in series between the capacitor 124 and the piezoelectric oscillator 14. The filter inductor 20 is used to filter out the noise generated during resonance of the quasi-resonant switching module 12, meanwhile, the filtering capability of the piezoelectric oscillator 14 can be enhanced, such as to block the noise generated by the parasitic capacitance on the piezoelectric oscillator 14, to optimize the sine wave characteristic of the piezoelectric current.

Figure 5:
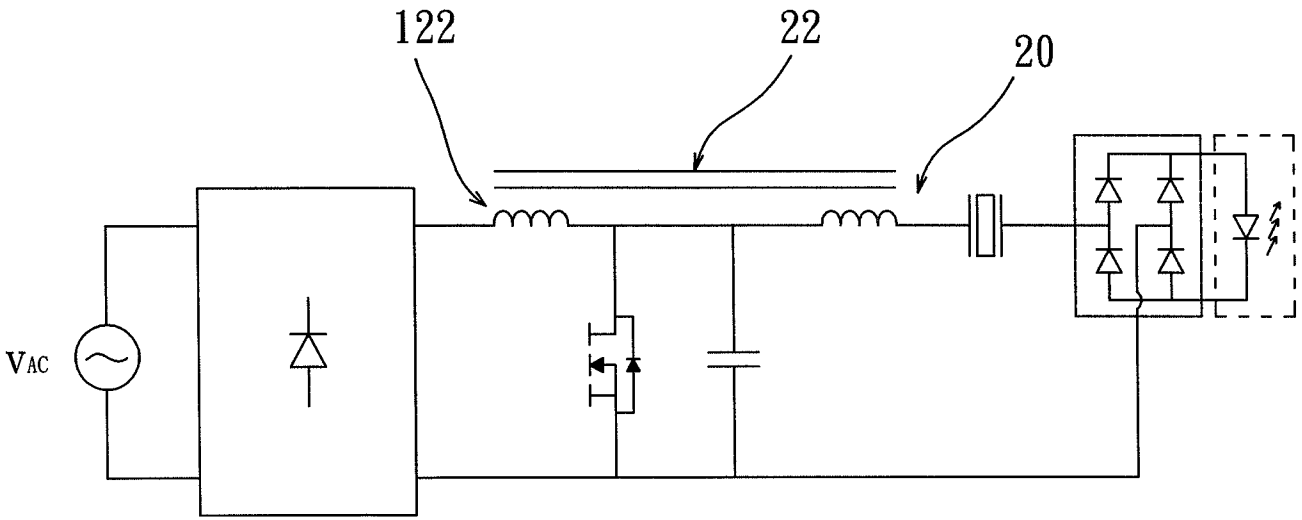
FIG. 5 is a circuit diagram of a piezoelectric resonant LED driving circuit according to a third embodiment of the present invention.

Refer to FIG. 5 for a circuit diagram of a piezoelectric resonant LED driving circuit according to a third embodiment of the present invention. The difference between the third embodiment and the second embodiment is that, in the third embodiment, the inductor 122 and the filter inductor 20 are wound around a same iron core 22, to form an autotransformer, to raise its voltage transfer capability. In other words, to increase the inductive voltage on the inductor 122 and the filter inductor 20.

Figure 6:
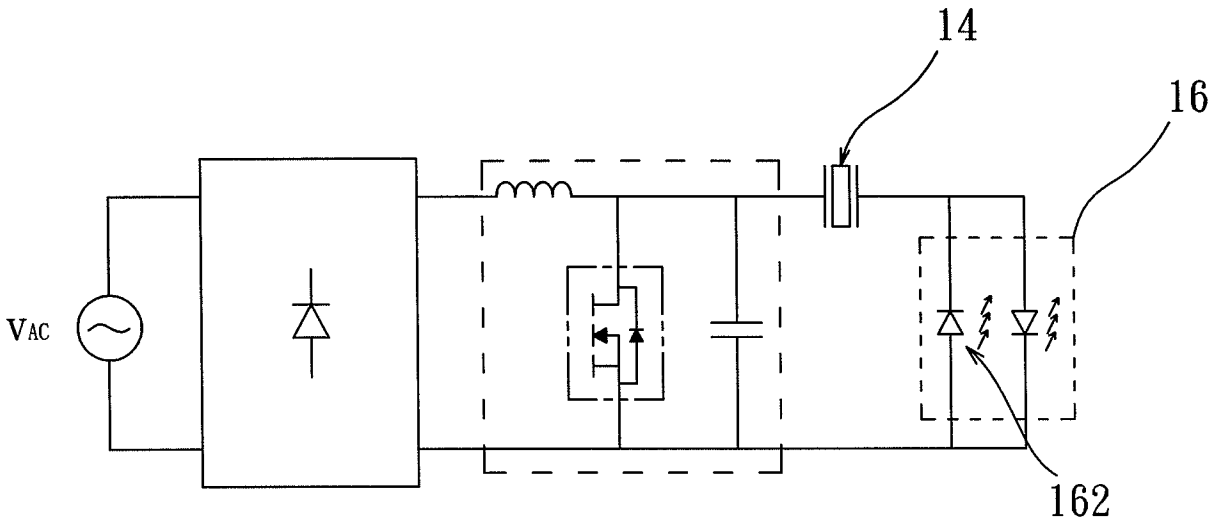
FIG. 6 is a circuit diagram of a piezoelectric resonant LED driving circuit according to a fourth embodiment of the present invention.

Refer to FIG. 6 for a circuit diagram of a piezoelectric resonant LED driving circuit according to a fourth embodiment of the present invention. The difference between the fourth embodiment and the first embodiment is that, in the fourth embodiment, the LED module 16 is provided with rectifying capability, to rectify the sine wave current provided by the piezoelectric oscillator 14 into a DC current capable of driving an internal LED element 162 to emit lights. As such, it can reduce the cost of rectifier circuit, to simplify the design of the entire LED driving circuit, to make it light weight and thin profile, and having a good competitive edge on the market.

Figure 7:
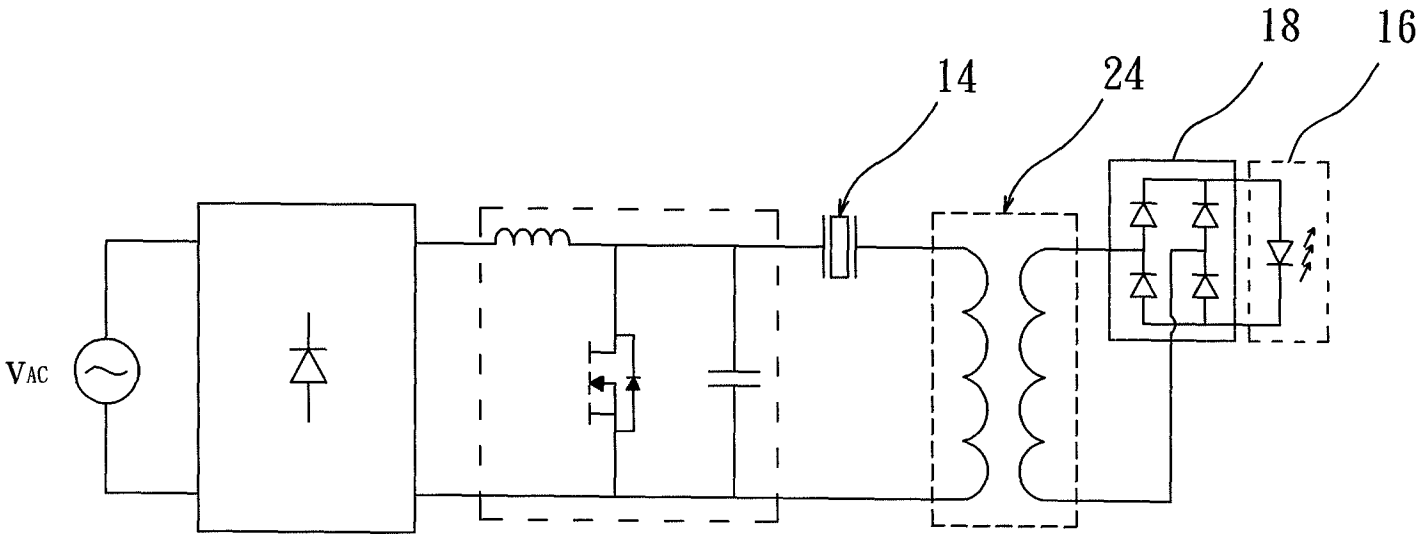
FIG. 7 is a circuit diagram of a piezoelectric resonant LED driving circuit according to a fifth embodiment of the present invention.

Refer to FIG. 7 for a circuit diagram of a piezoelectric resonant LED driving circuit according to a fifth embodiment of the present invention. The difference between the fifth embodiment and the first embodiment is that, in the fifth embodiment, a transformer 24 is added, and is connected between the piezoelectric oscillator 14 and the rectifier circuit 18. The transformer 24 is used to isolate the noise generated during resonance of the quasi-resonant switching module 12; or the transformer 24 is used to raise the driving voltage of the LED module 16.

Figure 8:
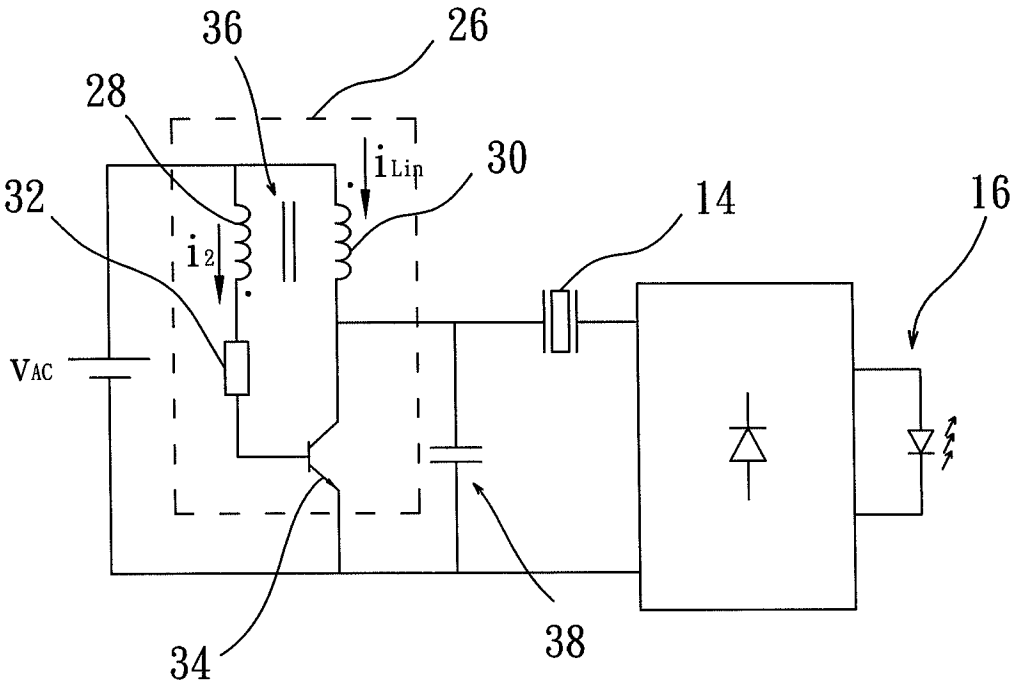
FIG. 8 is a circuit diagram of a piezoelectric resonant LED driving circuit according to a sixth embodiment of the present invention.

Refer to FIG. 8 for a circuit diagram of a piezoelectric resonant LED driving circuit according to a sixth embodiment of the present invention. The difference between the sixth embodiment and the first embodiment is that, in the sixth embodiment, a blocking oscillator is added to achieve self-resonance. The operation principle of the blocking oscillator and the quasi-resonant switching module 12 are the same, yet their internal circuit designs are slightly different, such that the energy transfer approach of the two circuits are slightly different, and that will be described in detail later. The blocking oscillator 26 includes a first inductor 28, a second inductor 30, a resistor 32, and a BJT switch 34. The first inductor 28 and the second inductor 30 wound around an iron core 36 in opposite directions. The resistor 32 is connected between the first inductor 28 and the base of the BJT switch 34. The collector of the BJT switch 34 and the capacitor 38 are connected in parallel, and then they are connected between the second inductor 30 and the piezoelectric oscillator 14. When the blocking oscillator 26 is activated, a current ($i_2$) flowing through the first inductor 28 and the resistor 32 turns on the BJT switch 34. When the BJT switch 34 is switched on, the second inductor 30 starts to be charged. Meanwhile, since the first inductor 28 and the second inductor 30 are coupled in reverse directions, the base current ($i_b$) of the second inductor 30 starts to decrease, as shown in the time interval t2-t0 of FIG. 9. When the base current ($i_b$) is overly small as compared with collector current ($i_c$), the BJT switch 34 is switched off, having the following switching off relations:

$$i_b < i_c/\beta$$

Wherein, $i_b$ is a base current, $i_c$ is an emitter current, and β is an amplification factor of BJT switch 34. When the BJT switch 34 is switched off; the second inductor 30 and the capacitor 38 start to resonate, in the time interval t1-t2, as shown in the drawing. At the end of resonance of the second inductor 30 and the capacitor 38, the input current ($i_2$) turns on the BJT switch 34 again by flowing through the first inductor 28 and the resistor 32. It is worth to note that, t0 and t2 shown in the drawing are a same point, such that in this embodiment, the BJT switch 34 does not require active trigger signal from outside, it only requires a coil and a resistor 32, to reduce significantly the circuit cost.

Figure 9:
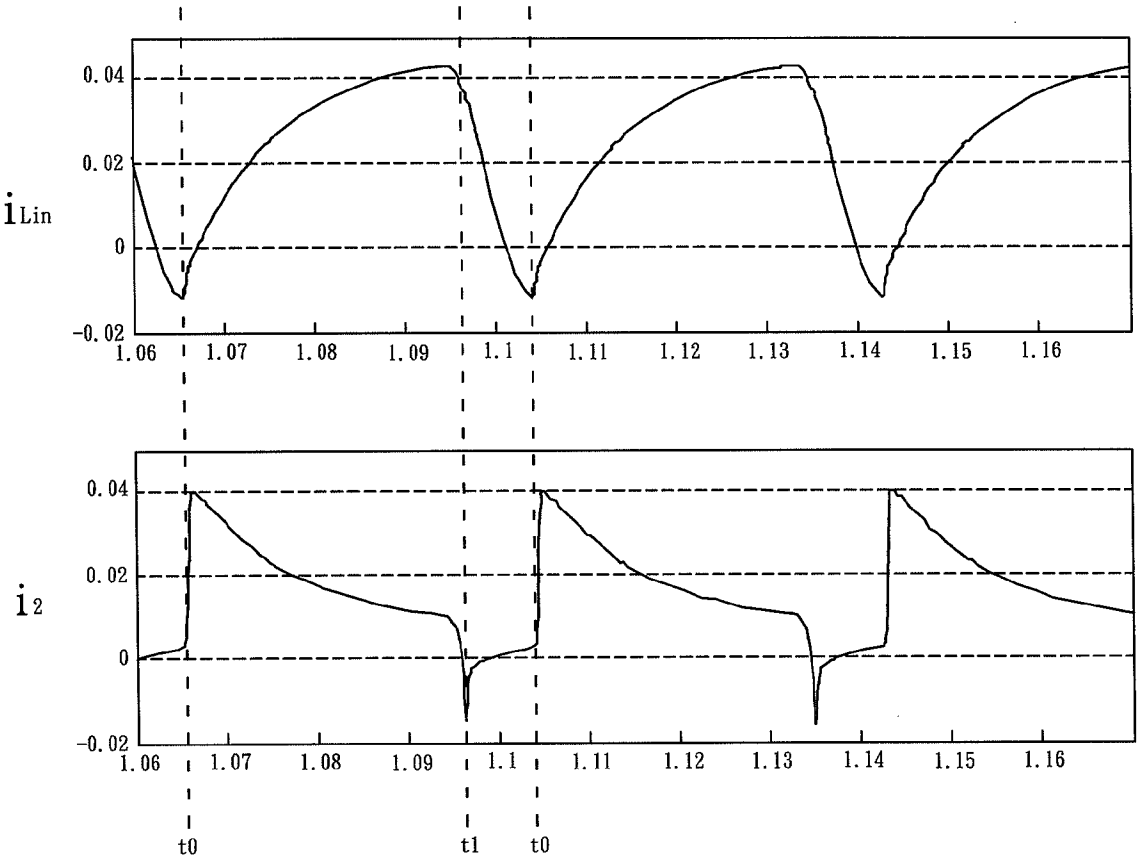
FIG. 9 is another waveform diagram of the quasi-resonant switching module in operation according to the present invention.

Finally, refer to FIG. 9 for another waveform diagram of the quasi-resonant switching module in operation according to the present invention. As shown in FIG. 9, it can be known that, for the blocking oscillator in the time interval t0 (at time axis about 1.065) to t1 (at time axis about 1.095), the BJT switch 34 is switched on, such that at this time, the second inductor 30 is charged. Then, in the time interval t1 (at time axis about 1.095) to t0 (at time axis about 1.105), the BJT switch 34 is switched off, such that at this time, the second inductor 30 discharges, and the second inductor 30 and the piezoelectric oscillator 14 resonate together, with its waveform of piezoelectric voltage $V_C$ as shown in time interval t1-t2 of FIG. 3. It is worth to note that, in the embodiment of the blocking oscillator, at the end of resonance of inductor 30 and the piezoelectric oscillator 14, the BJT switch 34 is switched on immediately. Therefore, in this embodiment, t0 and t2 of FIG. 3 coincide. Since the second inductor 30 of the blocking oscillator 26 is able to provide the same $i_{Lin}$ as the first embodiment (compare waveforms of $i_{Lin}$ of FIGS. 3 and 9), hereby enabling the piezoelectric oscillator 14 to transfer energy through resonance, to drive the LED module 16.

Summing up the above, in the present invention, a single switch is used to replace double switches of the half-bridge design, so that it can achieve zero-voltage-switching (ZVS) during resonance, to reduce the switching power loss effectively and achieve circuit cost reduction.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A piezoelectric resonant LED driving circuit, comprising:

a rectifier, used to receive an AC voltage, to rectify it into a DC voltage;

a quasi-resonant switching module, connected to said rectifier, and includes an inductor, a capacitor, and a switch, said switch and said capacitor connected in parallel, and then said switch and said capacitor are connected to said inductor, to perform resonance using said DC voltage, to generate an induced current;

a piezoelectric oscillator, connected to said quasi-resonant switching module, to receive said induced current, and produce a sine wave current after resonating and filtering said induced current; and an LED module, connected to said piezoelectric oscillator to receive said sine wave current, and rectify said sine wave current into a DC current to drive said LED module.

2. The piezoelectric resonant LED driving circuit as claimed in claim 1, wherein when said switch is switched on, said DC voltage starts to charge said inductor, to increase said induced current of said inductor; when said switch is switched off, said inductor discharges to said capacitor, to start charging said capacitor, so that voltage of said capacitor is raised from a low voltage level to a high voltage level.

3. The piezoelectric resonant LED driving circuit as claimed in claim 1, wherein said LED module further utilizes a rectifier circuit to receive said sine wave current, and rectify said sine wave current into said DC current, to drive said LED module to emit light, and said rectifier circuit is connected between said piezoelectric oscillator and said LED module.

4. The piezoelectric resonant LED driving circuit as claimed in claim 3, further comprising: at least a transformer, connected between said piezoelectric oscillator and said rectifier circuit, to isolate noise generated by said Quasi-resonant switching module during resonance, or to increase driving voltage of said LED module.

5. The piezoelectric resonant LED driving circuit as claimed in claim 1, wherein resonance frequency of said inductor and said capacitor is greater than switching frequency of said switch, and resonating-and-filtering frequency of said piezoelectric oscillator, and switching frequency of said switch is greater than resonating-and-filtering frequency of said piezoelectric oscillator.

6. The piezoelectric resonant LED driving circuit as claimed in claim 1, further comprising: a filter inductor, connected in series between said capacitor and said piezoelectric oscillator, to filter out noise generated by said quasi-resonant switching module during resonance.

7. The piezoelectric resonant LED driving circuit as claimed in claim 6, wherein said inductor and said filter inductor are wound around a same iron core, to form an autotransformer, and to raise induced voltage of said inductor.

* * * * *